US006293651B1

(12) United States Patent
Sawano

(10) Patent No.: US 6,293,651 B1
(45) **Date of Patent: *Sep. 25, 2001**

(54) MULTI-HEAD PRINTER

(75) Inventor: Mitsuru Sawano, Shizuoka (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/102,919

(22) Filed: Jun. 23, 1998

(30) Foreign Application Priority Data

Jun. 24, 1997 (JP) ..... 9-167397

(51) Int. Cl.[7] ..... B41J 2/15
(52) U.S. Cl. ..... 347/40; 347/41; 347/42
(58) Field of Search ..... 347/40, 41, 42, 347/43, 12, 13

(56) References Cited

U.S. PATENT DOCUMENTS

Re. 28,219 * 10/1974 Taylor ..... 347/42
3,560,641 * 2/1971 Taylor .
5,057,854 * 10/1991 Pond et al. ..... 347/42
5,583,550 * 12/1996 Hickman et al. ..... 347/40
5,587,730 * 12/1996 Karz ..... 347/43
5,677,719 * 10/1997 Granzow ..... 347/42
5,710,582 * 1/1998 Hawkins et al. ..... 347/42

FOREIGN PATENT DOCUMENTS

0023433 * 5/1981 (EP) ..... 347/42

* cited by examiner

*Primary Examiner*—N. Le
*Assistant Examiner*—Lamson D. Nguyen
(74) *Attorney, Agent, or Firm*—Sughrue, Mion, Zinn, Macpeak & Seas, PLLC

(57) ABSTRACT

To provide an inexpensive printer capable of printing a high-resolution print data item at high speed. A multi-head printer, wherein taking a pitch at which the printing elements are moved in the secondary scanning direction, or in the direction in which the printing elements are arranged, as "p," and "j" as a natural number, and a pitch between the printing heads as "Q," a relationship between the printing heads and their movement in the secondary scanning direction is defined so as to satisfy a relationship Q=j×p.

9 Claims, 3 Drawing Sheets

Q
N
p
d
d/n

MULTI-HEAD PRINTER

BACKGROUND OF INVENTION

The present invention relates to a printer which prints data at high speed through use of a multi-head having a plurality of printing heads placed thereon, wherein the printing heads form a plurality of printing elements. More particularly, the present invention relates to an ink-jet printer, a laser printer, an LED printer, or a thermal recording printer.

The dominant existing printer for recording a color image is an inexpensive color printer having a simple structure. In order to enable a common ink-jet serial printer such as that shown in FIG. 4 to print a high-quality monochrome or color image at high speed, the resolution of nozzles must be increased by increasing the density of nozzles of a printing element 101, the element recording an image on recording paper 102 wrapped around a platen 103, as well as to increase the printing speed of the printing element 101 by increasing its length in the secondary scanning direction and increasing the number of nozzles. As a result of a reduction in the particle weight of a droplet to be squirted from the nozzle and an increase in the number of nozzles, an inexpensive ink-jet printer having a resolution of about 720 dpi has recently been realized.

However, a further increase in the density of printing elements involves an increase in the precision of a mechanism including the printing elements, thus adding to the cost. To prevent an increase in the cost, there is employed an interlaced driving method which uses a plurality of comb-shaped heads arranged in the primary scanning direction and offset from one another in the secondary scanning direction.

FIG. 5 shows nozzles of a conventional interlaced printing apparatus. Reference numeral 301 designates a nozzle for squirting recording ink (hereinafter may be referred to simply as "ink"); 302 to 305 designate ink squirting elements; 307 designates a retaining section; and 308 designates printing signal cables and ink feed pipes. The plurality of nozzles 301 are arranged in a line at given intervals, and one head is wholly formed from a plurality of nozzle lines. At the time of a primary scanning operation, data corresponding to print positions are supplied to the squirting elements 302 by way of the cables 308, so that ink is squirted from the nozzles 301 to thus record the data on the paper.

However, in the conventional interlaced printing apparatus, the number (N) of nozzles 301 constituting a multi-nozzle is 15, and the nozzles 301 are formed at a pitch (K) of 4 or so. Accordingly, the resolution of the nozzles is 720 dpi or less. If an attempt is made to increase the density of printing elements in order to increase resolution to 1000 dpi or more, which allows printing of halftone dots, the apparatus suffers a problem of a drop in print speed.

If an attempt is made to increase the print speed by increasing the number of nozzles, manufacturing yields of a print head are deteriorated, adding to cost.

SUMMARY OF INVENTION

To solve the foregoing problems, the object of the present invention is to provide a high-resolution, inexpensive multi-head printer which enables even a print head having a smaller number of nozzles to print data at high speed.

To accomplish the foregoing object, according to a first aspect of the present invention, there is provided a multi-head printer for printing an image on a medium, comprising: a plurality of printing heads, each head having a plurality of printing elements formed thereon at given pitches; and a multi-head to which the printing heads are fixed in one line at equal pitches.

According to a second aspect of the invention, there is provided the multi-head printer of the first aspect, wherein an interlaced printing operation is performed a plurality of times through use of the multi-head.

According to a third aspect of the invention there is provided the multi-head printer described above, further comprising: a drum having an outer periphery around which the medium is wrapped so as to face the multi-head, wherein the interlaced printing operation is carried out in the primary scanning direction through rotation of the drum.

With the foregoing configurations, a print data item is recorded on the recording paper wrapped around the outer periphery of the platen drum, by actuation of the multi-head having the printing elements provided in one line thereon in the primary scanning direction while the platen drum is rotated in the primary scanning direction, thus enabling simple interlaced recording of a print data item.

According to a fourth aspect of the invention, there is provided the multi-head printer described above, wherein the interlaced printing operation is carried out in the primary scanning direction by back-and-forth actuation of the multi-head.

According to a fifth aspect of the invention, there is provided the multi-head printer described above, wherein taking a pitch at which the printing elements are moved in the secondary scanning direction, or in the direction in which the printing elements are arranged, as "p," and "j" as a natural number, and a pitch between the printing heads as "Q," a relationship between the printing heads and their movement in the secondary scanning direction is defined so as to satisfy a relationship $Q=j\times p$. As a result, a scanned area can be precisely filled without clearance or an overlapped portion through scanning operations carried out a plurality of times ("j" times).

Prefarably, the printing elements for each head are arranged to satisfy following equations: $p=Nd$, and $N=kn+1$, where N represents the number of printing elements effectively used in an actual printing operation, d represents the pitch of the printing elements, k represents a natural number, and n represents the number of divisions between the adjacent printing elements.

DETAILED DESCRIPTION OF PREFERRED EMBODIMENTS

Preferred embodiments of the invention will be described by reference to the accompanying drawings.

Figure 1:
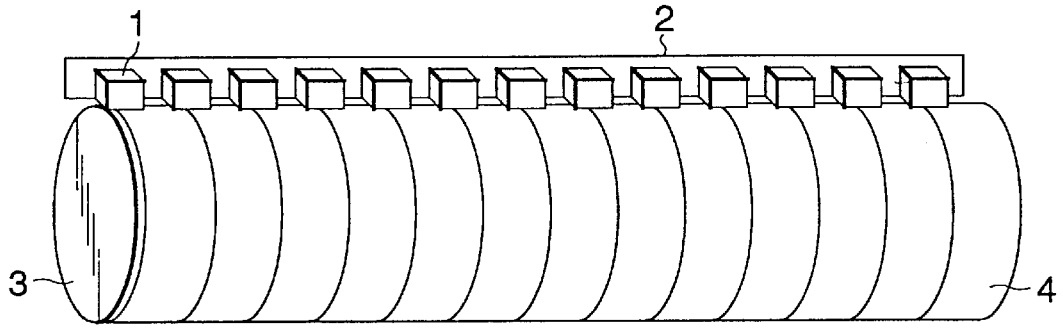
FIG. 1 is a perspective view showing a multi-head ink-jet printer according to embodiments of the present invention.
Figure 2:
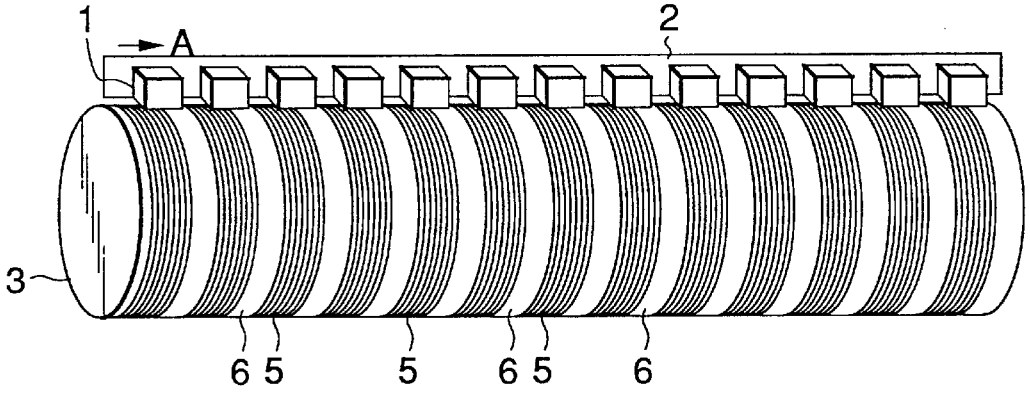
FIG. 2 shows a primary-scan record data item formed by the ink-jet printer according to the embodiment of the invention.
Figure 3:
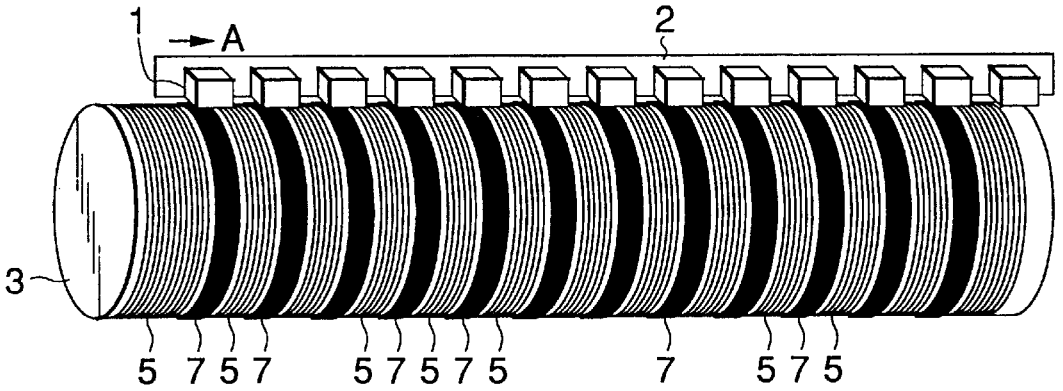
FIG. 3 shows an interlaced record data item formed by the printer according to the embodiment of the invention.
Figure 4:
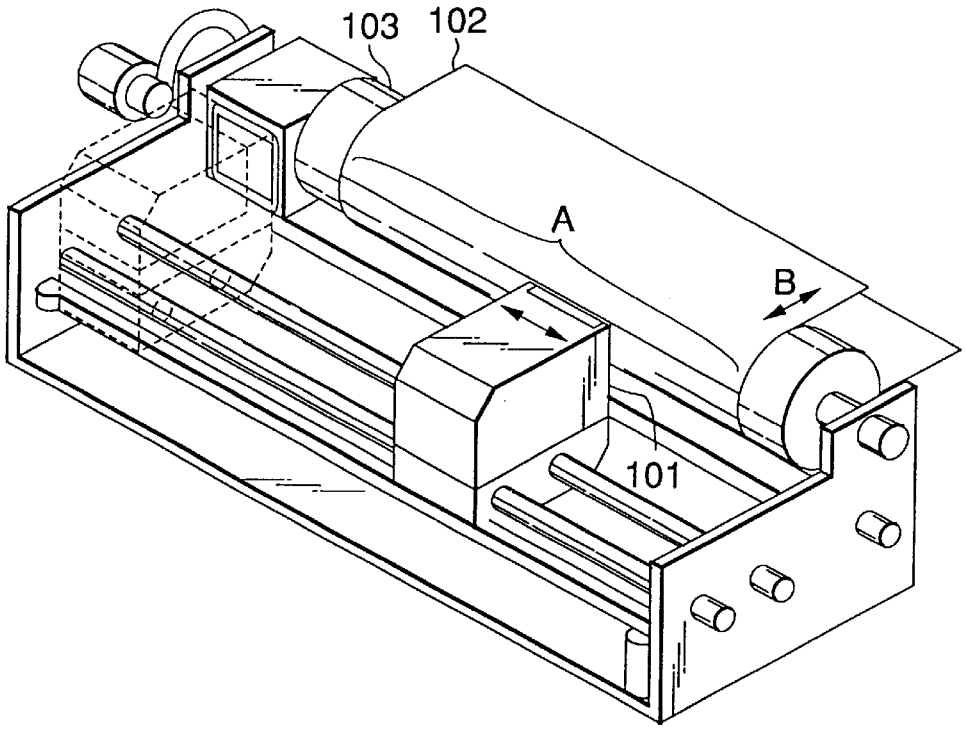
FIG.4 PRIOR ART
FIG. 4 is a perspective view showing a conventional ink-jet printer.
Figure 5:
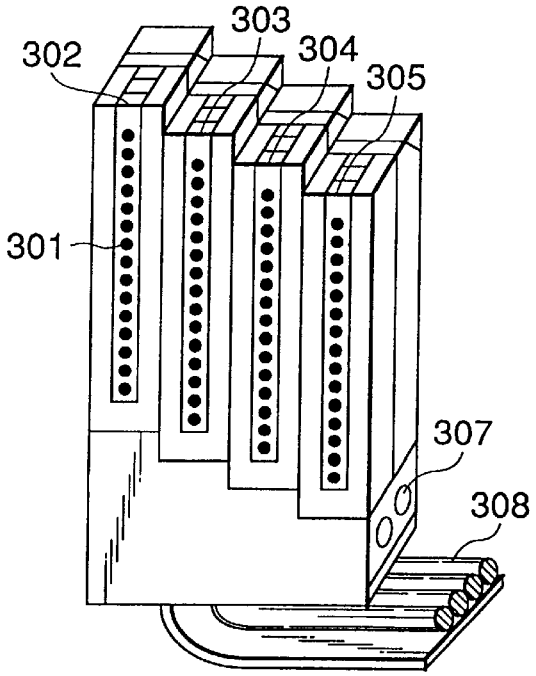
FIG.5 PRIOR ART
FIG. 5 is a perspective view showing a conventional multi-nozzle.

FIG. 1 is a perspective view showing the principal elements of a multi-head ink-jet printer according to embodiments of the present invention. FIG. 2 is a view similar to that of FIG. 1, but showing a primary-scan record data item formed by the ink-jet printer shown in FIG. 1. FIG. 3 is a view similar to that of FIG. 1, but showing an interlaced record data item formed by the printer shown in FIG. 1.

In FIG. 1, printing elements 1 have multi-nozzles M1, M2, M3, M4, . . . (corresponding to, e.g., cyan, magenta, yellow, black, one intermediate color, or a plurality of intermediate colors). A multi-head 2 is formed by arranging the plurality of printing elements 1 in a line in a direction orthogonal to the primary scanning direction.

A recording paper 4 is wrapped around a platen drum 3. The drum 3 rotates in the primary scanning direction, and the multi-head 2 records data on the paper 4 through a primary scanning operation. Although the drum 3 may rotate either clockwise or counterclockwise, in the present embodiments the drum 3 is assumed to rotate counterclockwise.

In the present embodiments, the primary scanning direction is a direction in which data are recorded on the paper 4 while the paper is rotated by means of the drum 3. Accordingly, the initial primary scanning operation involves rotation of the platen drum 3, as well as by the primary scanning operation involving mere rotation of the platen drum 3 after movement of the multi-head 2 in a longitudinal direction. The present embodiments do not involve any secondary scanning operation, which has been carried out by the conventional printer. The multi-head 2 records data on the paper 4 in the primary scanning direction while the platen drum 3 rotates the paper 4. A data item recorded through such a printing operation will be referred to as a "primary-scan record data item." After the multi-head 2 has been moved in a longitudinal direction, a data item is recorded between existing data items, which have already been recorded by the adjacent printing elements during the preceding primary scanning operation, through rotation of the platen drum 3. A data item recorded by such a printing operation will be referred to as an "interlaced record data item." As mentioned previously, the present embodiments involve solely the primary scanning operation and two types of printing operations: that is, a primary-scan printing operation and an interlaced printing operation.

The operation of the foregoing ink-jet printer will be described hereinbelow. As shown in FIG. 2, with regard to the initial primary-scan printing operation, an image record signal is sent to each of the printing elements 1 of the multi-head 2, making one rotation of the platen drum 3 in a counterclockwise direction. As a result, a data item is printed on the paper 4. After one rotation of the platen drum 3, the printing elements 1 are moved at given pitches in a direction designated by arrow A. One rotation of the platen drum 3 is again made to thus print a data item on the paper 4. FIG. 2 shows the result of data item printing obtained after the printing operations have been repeated seven times. Reference numeral 5 designates lines thus printed, and 6 designates a blank into which lines will be printed hereafter.

After lines have been printed on the white space 6, an interlaced printing operation will be carried out. The printing elements 1 (i.e. the multi-head 2) are (is) moved to a given position in the direction designated by arrow A in such a way as to come to a space between the lines which have been recorded by the adjacent printing elements during the preceding printing operation. After completion of movement of the printing elements 1, an interlaced printing operation is performed by rotating the platen drum 3 again in a counterclockwise direction, as in the case of the primary-scan printing operation. FIG. 3 shows the interlaced printing operation. The drawing shows a simple example in which the width of a dot line formed by the printing element 1 corresponds to one-half the pitch between the printing elements 1. From the drawing, it can be understood that the overall scanned area is filled with dot lines 5 formed through one primary-scan printing operation and with dot lines 7 formed through one interlaced printing operation.

FIGS. 6A to 6F are schematic representations for explaining, in a more general manner, an interlaced printing operation which does not create a space or an overlapped area between dot lines.

Figures 6A, 6B, 6C, 6D, 6E, 6F:
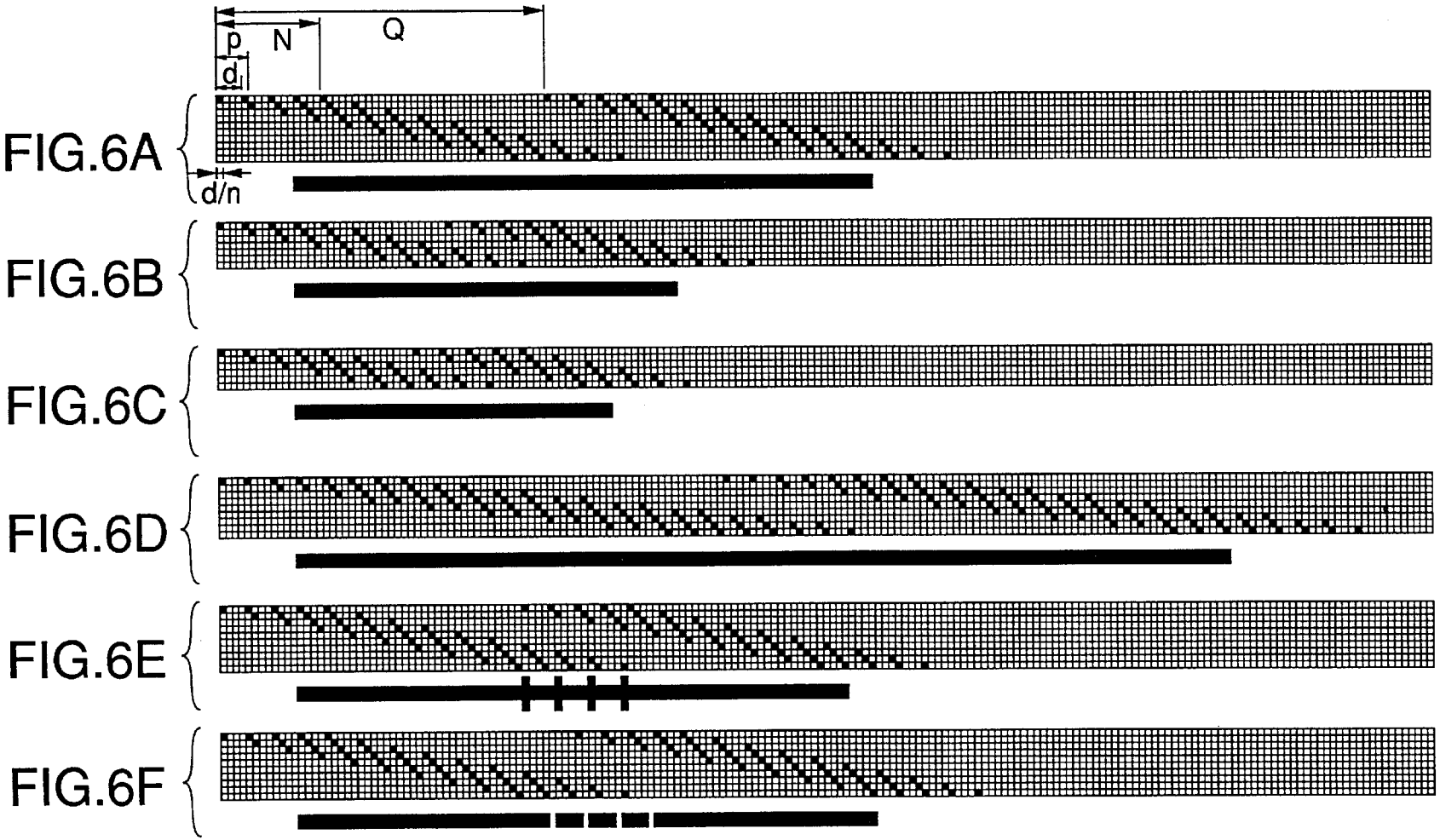
FIGS. 6A to 6F are schematic representations for explaining, in a more general manner, an interlaced printing operation which does not create a space or an overlapped area between dot lines.

Each of FIGS. 6A to 6F illustrates printing results of multi-heads, each multi-head comprising two printing heads. Each printing head comprises five printing elements (N=5) or nine printing elements (N=9), and the printing elements of one head are arranged at a pitch differing from that at which the printing elements of the other head are arranged. In this example, a pitch (d) between the printing elements corresponds to a value which represents four times the width of a dot line formed by each printing element. In short, the width of the dot line formed by each printing element corresponds to d/n. Accordingly, the space between the adjacent printing elements can be filled by scanning the printing element four times. One row of cells shown in the drawing represents a dot line width d/n of one printing element. One column of cells represents one scanning operation. In each of FIGS. 6A to 6F, black cells in the top row represent first scanning positions. FIGS. 6A to 6C, 6E and 6F show the positions of the first dot lines formed by respective multi-heads, each multi-head comprising five printing elements (N=5). The printing elements are arranged at different pitches (Q): that is, the printing elements of the multi-head shown in FIG. 6A are arranged at Q=50; those of the multi-head shown in FIG. 6B are arranged at Q=35; those of the multi-head shown in FIG. 6C are arranged at Q=30; those of the multi-head shown in FIG. 6E are arranged at Q=46; and those of the multi-head shown in FIG. 6F are arranged at Q=54. FIG. 6D shows the position of the first dot line formed by the multi-head comprising two printing heads, each printing head comprising nine printing elements (N=9). The printing elements are arranged at Q=81. Black cells in the second row represent the second scanning positions. In FIGS. 6A to 6C, 6E and 6F, the second dot line is formed at a position which is spaced five cells apart from the first scanning position (i.e., far-positioned one of the two cells adjacent to the first dot line formed by the adjacent printing element). In FIG. 6D, the second dot line is formed at a position which is spaced nine cells apart from the first scanning position (i.e., far-positioned one of the two cells adjacent to the first dot line formed by the printing element after the next adjacent printing element). Taking the number of printing elements skipped from the first scanning position to the second scanning position as "k," the feed pitch as "p," the pitch between the printing heads as "Q," and "j" as a natural number, the result of the interlaced printing operation shown in FIG. 6A, for example, is expressed as k=1 (i.e., the number of printing elements to be skipped is one), n=4 (i.e., the width of the dot line formed by the printing element is d/4), p=5×d/4 (taking d=4 for simplicity, p=5), N=5 (i.e., the number of printing elements in one head), j=10, and Q=50 (i.e., the pitch between the heads).

In the foregoing circumstance, the present invention has revealed that Q=j×p must be satisfied in order to realize an interlaced printing operation to uniformly fill the paper. The reason for this will be explained hereinbelow by reference to FIGS. 6A through 6F.

In the case of the recording result shown in FIG. 6A, j×p=10×5=50 and Q=50 lead to Q=50=j×p. Accordingly, the result shown in FIG. 6A is uniformly filled through an interlaced printing operation.

This is obvious from the lower part of FIG. 6A, which clearly shows that the scanned area is uniformly filled without either an overlapped portion or a blank. The scanned area is indicated in the form of a black thick line. With regard to the recording result shown in FIG. 6B, given that k=1, n=4, p=5,

N=5, j=7,

Q=35, and j×p=7×5=35, we have Q=35=j×p. Accordingly, the result shown in FIG. 6B is uniformly filled through an interlaced printing operation. This is obvious from the lower portion of FIG. 6B, which clearly shows that the scanned area is uniformly filled without either an overlapped portion or a blank. The scanned area is indicated in the form of a black thick line.

With regard to the recording result shown in FIG. 6C, given that k=1, n=4, p=5,

N=5, j=6,

Q=30, and j×p=6×5=30, we have Q=30=j×p. Accordingly, the result shown in FIG. 6C is uniformly filled through an interlaced printing operation. This is obvious from the lower portion of FIG. 6C, which clearly shows that the scanned area is uniformly filled without either an overlapped portion or a blank. The scanned area is indicated in the form of a black thick line.

With regard to the recording result shown in FIG. 6D, given that k=2 i.e., the number of printing elements to be skipped is two), n=4, p=9,

N=9, j=9,

Q=81, and j×p=9×9=81, we have Q=81=j×p. Accordingly, the result shown in FIG. 6D is uniformly filled through an interlaced printing operation. This is obvious from the lower portion of FIG. 6D, which clearly shows that the scanned area is uniformly filled without either an overlapped portion or a blank. The scanned area is indicated in the form of a black thick line.

With regard to the recording result shown in FIG. 6E, given that k=1, n=4, p=5,

N=5, j=10,

Q=46, and j×p=10×5=50, we have Q≠j×p. Accordingly, the result shown in FIG. 6E is not uniformly filled through an interlaced printing operation. This is obvious from the lower portion of FIG. 6E, which clearly shows that overlapped areas exist in the scanned area. These overlapped areas are indicated by vertical thick black lines (four lines).

With regard to the recording result shown in FIG. 6F, given that k=1, n=4, p=5,

N=5, j=10,

Q=54, and j×p=10×5=50, we have Q≠j×p. Accordingly, the result shown in FIG. 6F is not uniformly filled through an interlaced printing operation. This is obvious from the lower portion of FIG. 6F, which clearly shows that white blank spaces exist in the scanned area. These blanks are indicated by white spaces (four white spaces).

As has been mentioned previously, with regard to the aforementioned multi-head printer, provided that the pitch at which the printing elements are moved in the secondary scanning direction is "p," "j" is a natural number, and the pitch between the printing heads is "Q," the scanned area can be precisely filled without either a blank or an overlapped portion through scanning of the area a plurality of times ("j" times), so long as Q=j×p is satisfied.

The conditions for arrangement of printing elements in one printing head conform with Equations (1) and (2) are:

$$p=d(1/n+k) \quad \text{(Eq. 1)}$$

and $$N=n\times m+1 \quad \text{(Eq. 2).}$$

Here, m=k is preferable, and all the aforementioned embodiments are based on this condition. In the preferable parameter, the Equations express:

$$p=Nd/n \quad \text{(Eq. 3)}$$

and $$N=kn+1 \quad \text{(Eq.4).}$$

N is the number of printing elements effectively used in an actual printing operation. No problem arises even if printing elements which are greater in number than N are provided for the printer for a purpose other than ordinary printing.

In the case of a high-quality color printing operation, the color of one of the two heads of the multi-head 2 is changed to another color. The dot lines 7 are formed through second, third, and more interlaced printing operations while the multi-head 2 is moved in the direction A in the same manner as in the previous embodiments.

Although, in the foregoing embodiments, the platen drum 3 is rotated counterclockwise to effect the primary scanning operation, interlaced scanning operations may be performed on the basis of the same principle as that on which the foregoing embodiments are based, by actuating the multi-head 2 back and forth over plane recording paper in the primary scanning direction without use of the platen drum 3.

Since ordinary users have widened the scope of application of a color printer to include applications such as the development of photographs taken by a digital camera, even a low-priced color printer is required to produce an image of near-photographic silver-salt print quality. Under the present circumstances in which there is a demand for immediate realization of a high-quality, high-precision, and low-priced printer, there is already available a low-priced color printer which has 32 nozzles for each of the four principal colors, which is capable of producing six colors, including intermediate colors, and which provides a resolution of about 720 dpi. However, an increase in the printer mechanism is not sufficient to realize a print having a halftone dot of 1000 dpi or a high-resolution print close to a silver-salt photographic print. Therefore, an interlaced scanning method must be adopted. However, such a high-resolution print cannot be realized solely by adoption of a conventioal interlaces canning method. Accordingly, as has been described for the previous embodiments, high-resolution print has not be realized until the interlaced scanning operation is performed through use of the multi-head such as that used for the embodiments.

In the foregoing embodiments, since an interlaced printing operation is performed while the printing elements 1 of the multi-head are arranged in one line, a relative print speed is increased. Therefore, a high-resolution printing can be effected, in turn enabling a significant reduction in the range in which an ineffective interlaced area is apt to arise.

Although the foregoing descriptions have primarily explained an application in which the present invention is utilized for a low-cost color printer, the present invention is not limited solely to such an application. Since the present invention provides high-resolution quality, needless to say the present invention can also be applied to an application such as a color proofer (or a proof print) for printing purposes.

The present invention can also be applied to preparation of a press plate, so long as a data item is printed on a press plate having lipophilic properties through use of oil-repellent ink. In such a case, ink having lipophilic properties and an oil-repellent press plate may also be used.

Further, the present invention can be applied to lith film or a mask film used for converting halftone dots, so long as a data item is printed on a transparent support through use of a high concentration of ink.

As has been described above, according to the present invention, a plurality of printing elements are arranged in one line at equal intervals, and an interlaced scanning operation is performed several times through use of the printing elements. Although the pitch between heads must originally be reduced in order to produce a high-resolution print, the print head pitch cannot be reduced to a given pitch or less. As a result of the interlaced printing operation according to the present invention, there can be realized a high-precision print, which could otherwise be produced only by use of a head pitch less than the minimum-possible pitch.

Further, an existing multi-head is used for the present invention, and hence it becomes possible for a low-priced printer to produce a high-resolution print at high speed.

What is claimed is:

1. A multi-head printer for printing an image on a medium, comprising:

a multi-head having a plurality of printing heads, each printing head having a plurality of printing elements formed thereon at equal pitches, said multi-head being moveable in a secondary scanning direction relative to said medium; and a drum having an outer periphery around which said medium is wrapped so as to face said multi-head, wherein said printing heads are constructed to print only during a primary scanning operation in which said print heads are moved relative to said medium in a primary scanning direction that is substantially orthogonal to said secondary scanning direction.

2. The multi-head printer according to claim 1, wherein the multi-head performs an interlaced printing operation by executing a plurality of primary scanning operations.

3. The multi-head printer according to claim 2, wherein the interlaced printing operation is carried out in the primary scanning direction by back-and-forth actuation of the multi-head.

4. The multi-head printer according to claim 2, wherein (1) "p" represents a pitch at which the printing elements are moved in a secondary scanning direction that is substantially parallel to the one line, during the interlaced printing operation, (2) "j" represents a natural number, and (3) "Q" represents a pitch between the printing heads; and wherein, during the interlaced printing operation, a relationship $Q=j\times p$ is satisfied.

5. The multi-head printer according to claim 4, wherein the printing elements for each printing head are arranged to satisfy following equations:

$$p=Nd,$$

and $$N=kn+1,$$

where (1) N represents a number of printing elements used in a printing operation, (2) d represents a pitch of the printing elements, (3) k represents a natural number, and (4) n represents a number of divisions between adjacent printing elements.

6. The multi-head printer according to claim 1, further comprising:

a drum having an outer periphery around which the medium is wrapped so as to face the multi-head;

wherein an interlaced printing operation is carried out in the primary scanning direction through rotation of the drum.

7. The multi-head printer according to claim 1, wherein an interlaced printing operation is carried out in the primary scanning direction by back-and-forth actuation of the multi-head.

8. The multi-head printer according to claim 1, wherein (1) "p" represents a pitch at which the printing elements are moved in a secondary scanning direction that is substantially parallel to the one line, during an interlaced printing operation, (2) "j" represents a natural number, and (3) "Q" represents a pitch between the printing heads; and wherein, during the interlaced printing operation, a relationship $Q=j\times p$ is satisfied.

9. The multi-head printer according to claim 8, wherein the printing elements for each printing head are arranged to satisfy following equations:

$$p=Nd,$$

and $$N=kn+1,$$

where (1) N represents a number of printing elements used in a printing operation, (2) d represents a pitch of the printing elements, (3) k represents a natural number, and (4) n represents a number of divisions between adjacent printing elements.

* * * * *